US006457257B1

(12) United States Patent
Hughes

(10) Patent No.: US 6,457,257 B1
(45) Date of Patent: Oct. 1, 2002

(54) PORTABLE FILM DRYER

(76) Inventor: Frank D. Hughes, 1887 Ox Bottom Rd., Tallahassee, FL (US) 32312

( * ) Notice: Subject to any disclaimer, the term of this patent is extended or adjusted under 35 U.S.C. 154(b) by 0 days.

(21) Appl. No.: 09/876,008

(22) Filed: Jun. 8, 2001

(51) Int. Cl.[7] ..... F26B 19/00

(52) U.S. Cl. ..... 34/218; 34/621; 34/622; 34/227

(58) Field of Search ..... 34/60, 68, 83, 34/84, 85, 104, 105, 106, 218, 227, 621, 622

(56) References Cited

U.S. PATENT DOCUMENTS 1,589,642 A * 3/1926 Harris ..... 34/621
2,376,174 A * 8/1942 Munning et al. ..... 34/87
3,280,477 A * 10/1966 Rawlings ..... 34/622
3,905,125 A * 9/1975 Hubner ..... 34/622
4,151,657 A * 5/1979 Jensen ..... 34/621

* cited by examiner

*Primary Examiner*—Denise L. Esquivel
*Assistant Examiner*—Kathryn S. O'Malley
(74) *Attorney, Agent, or Firm*—John Wiley Horton

(57) ABSTRACT

The present invention is a completely portable film dryer. The film is hung in strips within an encircling shroud. A heater assembly positioned at the top of the shroud blows warm air downward over the suspended film strips and out through exhaust vents near the shroud's bottom. A drip pan at the bottom of the shroud catches any free water drops. The entire unit, with the film placed inside, can be hung from a clothes hanger, shower curtain rod, or other suitable point. Power is provided to the heater assembly via a 110 volt AC plug or a DC adapter (for automotive cigarette lighters and the like). When not in use, the invention collapses to a significantly reduced size so that it can be transported in a suitcase or equipment container.

16 Claims, 7 Drawing Sheets

PORTABLE FILM DRYER

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention.

This invention relates to the field of photographic film processing. More specifically, the invention comprises a portable device for drying strips of photographic film in a controlled, dust-free environment.

2. Description of the Related Art.

The processing of film by the professional photographer or skilled amateur is often conducted by hand. The exposed film (negatives or slides) is chemically processed (developed) in a variety of solutions. All these solutions leave the film wet. Prior to further use, the film must be dried. The typical method is to cut the roll of film into lengths of two or three feet and hang these lengths up on a suspending line. Unfortunately, the film's surface is relatively soft when wet and this makes it particularly vulnerable to dust contamination. Accordingly, many processing facilities use a specially-equipped drying room, or semi-permanent fixtures in another type of room This approach uses controlled heat and air circulation. It also employs dust filters to minimize airborne contaminants.

While these types of specialized drying methods are effective, they obviously have practical limitations as far as cost and available space. More importantly, however, the professional photographer is often traveling away from a processing facility. He or she is therefore unable to use the specialized drying room or facility, even if such a room or facility is available. The only alternative is to hang the film strips in a conventional room—such as a bathroom. The results of this technique vary. Water remaining on the film for more than a few minutes will often cause streaks and spots. Dust contamination is also difficult to control. Dust particles which become partially embedded in the surface of the film are very difficult to remove without damaging the film itself. Accordingly, the principal drawback of the prior art devices available for film drying is that they are not portable. The prior art devices have additional disadvantages in that they:

1. Are expensive;
2. Consume significant space;
3. Fail to prevent contamination; and
4. Allow the formation of streaks and spots.

BRIEF SUMMARY OF THE INVENTION

The present invention is a completely portable film dryer. The film is hung in strips within an encircling shroud. A forced air heater assembly positioned at the top of the shroud blows warm air downward over the suspended film strips and out through exhaust vents near the shroud's bottom. A drip pan at the bottom of the shroud catches any free water drops. The entire unit, with the film placed inside, can be hung from a clothes hanger, shower curtain rod, or other suitable point. Power is provided to the heater assembly via a 110 volt AC plug or a DC adapter (for automotive cigarette lighters and the like).

When not in use, the invention collapses to a significantly reduced size so that it can be transported in a suitcase or equipment container. Accordingly, the objects and advantages of the present invention are to provide a portable film dryer which:

1. Is inexpensive;
2. Is compact;
3. Prevents dust contamination; and
4. Prevents the formation of streaks or spots on the film during the drying process.

REFERENCE NUMERALS IN THE DRAWINGS

Figure 1:
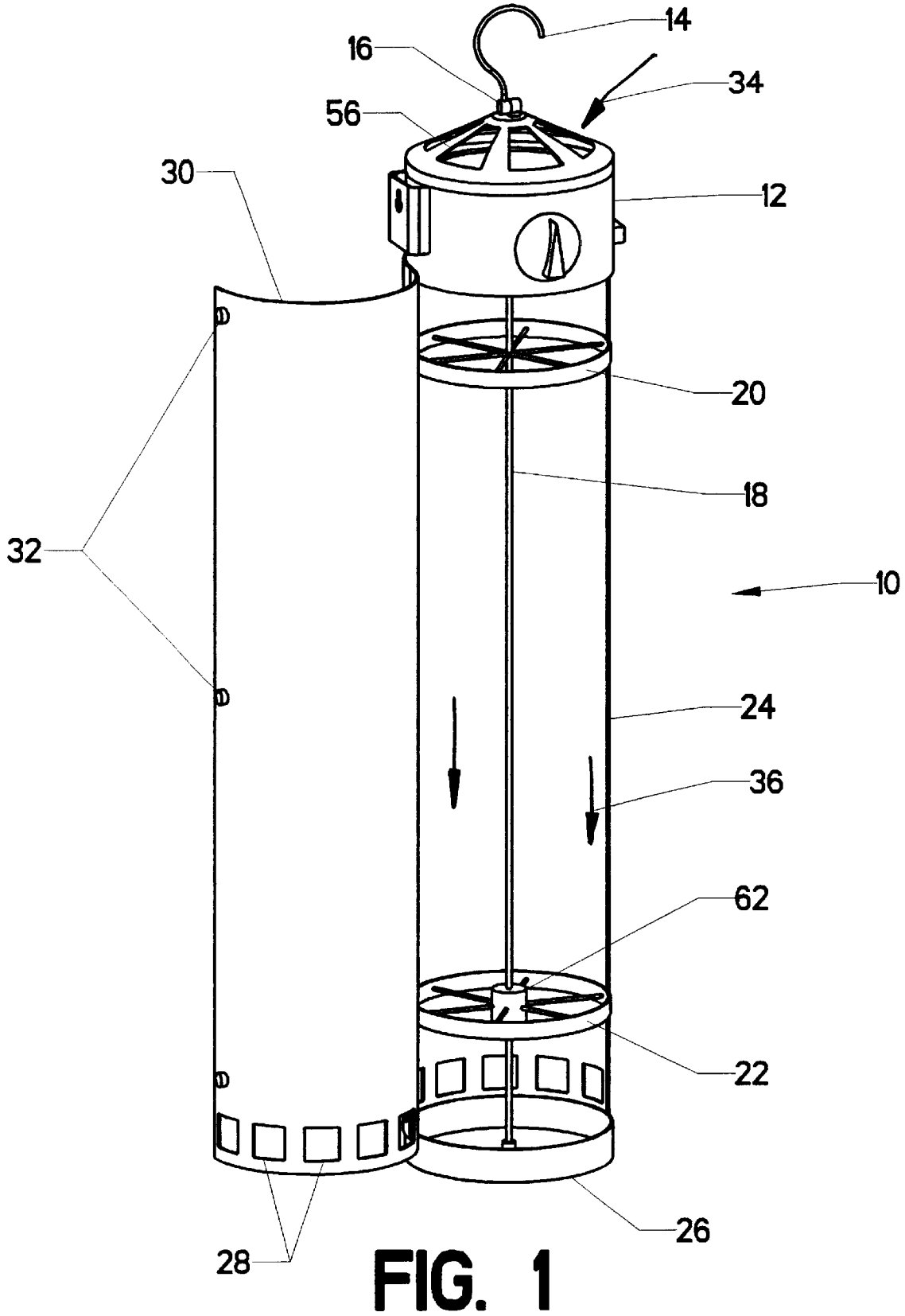
FIG. 1 is an isometric view, showing the proposed invention.

10 portable film dryer
14 hanging hook
18 support cable
22 lower film hanger
26 drip pan
30 access flap
34 ambient air
38 film strip
42 exhaust air
46 filter cartridge
50 fan
54 timer
12 heater assembly
16 swivel
20 upper film hanger
24 shroud
28 exhaust vent
32 snap closure
36 heated air
40 clip
44 top
48 body
52 power input
56 air intake
58 alternate drip pan

62 weight

66 keyhole slot

60 throttle vent

64 mounting boss

DETAILED DESCRIPTION OF THE INVENTION

FIG. 1 shows the invention fully assembled. When in use, portable film dryer 10 will commonly be hung vertically from a hanging rod in a closet or a shower curtain rod. Hanging hook 14 is provided for this purpose. Suspended beneath hanging hook 14 is heater assembly 12. Heater assembly 12 has an upper portion, an outer perimeter, and a lower portion. A plurality of air intakes 56 are formed in its upper portion. The function of heater assembly 12 is to pull in ambient air 34 through air intakes 56, heat it, and discharge it downward as heated air 36. The internal details of heater assembly 12 will be explained subsequently.

Support cable 18 descends downward from the lower portion of heater assembly 12. While cable 18 could be a rigid rod, it is preferable to make it a flexible cable so that portable film dryer 10 can be collapsed for storage when not in use. Upper film hanger 20 is hung from support cable 18 at a position beneath heater assembly 12. Upper film hanger 20 consists of a plurality of horizontally oriented rods radiating outward from support cable 18, bounded by a surrounding ring to provide stiffness. These radiating rods are used to attach the upper ends of the film strips to be dried, as will be explained subsequently.

Lower film hanger 22, which is positioned further down on support cable 18, is similar to upper film hanger 20. Its function is to secure the lower ends of the film strips to be dried. Weight 62 is provided in the middle of lower film hanger 22 to provide downward tension on the film strips when they are hung. Lower film hanger 22 is free to slide up and down support cable 18. A clamping mechanism capable of fixing it in one position may be provided as well. This allows the device to suspend film strips having different lengths.

Drip pan 26 is provided at the bottom extreme of portable film dryer 10. It is also suspended from support cable 18. The function of drip pan 26 is to catch any water droplets blown off the hanging film and prevent them from falling to the floor.

The reader will observe that heated air 36 will be blown over film strips hanging between upper film hanger 20 and lower film hanger 22, thereby drying them. However, absent an additional containments device, heated air 36 will deflect outward and fail to reach the lower portions of the hanging film strips. Shroud 24 is provided to concentrate and direct the flow of heated air 36. Shroud 24 is preferably a flexible material, such as the clear plastic used in shower curtains. It descends downward from the outer perimeter of heater assembly 12, where it is attached by any conventional means. The reader will observe that shroud 24 has an open lower end. This opening is sealed by drip pan 26. Again, the attachment between shroud 24 and drip pan 26 can be made by any conventional means. Once shroud 24 and drip pan 26 are in place, heated air 36 can only escape through exhaust vents 28, which are distributed around the lower end of shroud 24. By the use of shroud 24 and the positioning of exhaust vents 28, heated air 36 is forced to flow down the entire length of the hanging film strips, only being allowed to escape at the bottom.

It is obviously important to provide the user with access to the interior of shroud 24 so that the user may place and remove the film to be dried. Shroud 24 contains access flap 30 for this purpose. Access flap 30 is shown open in FIG. 1. In the open position, it allows the user to reach inside to place and remove film. When the user wishes to close access flap 30, a plurality of snap closures 32 will secure it in place. Those skilled in the art will realize that the perimeter of access flap 30 will leak some heated air 36 unless tightly sealed. In actuality, some leakage is acceptable with minimal compromise of the invention's function. So long as positive pressure is maintained within shroud 24, outside dust will not contaminate the drying process. Some leakage is therefore acceptable, as long as it does not significantly redirect the flow of heated air 36. Those skilled in the art will also realize that air leakage can be substantially eliminated by replacing snap closures 32 with magnetic strips or VELCRO-type fasteners.

Figure 2:
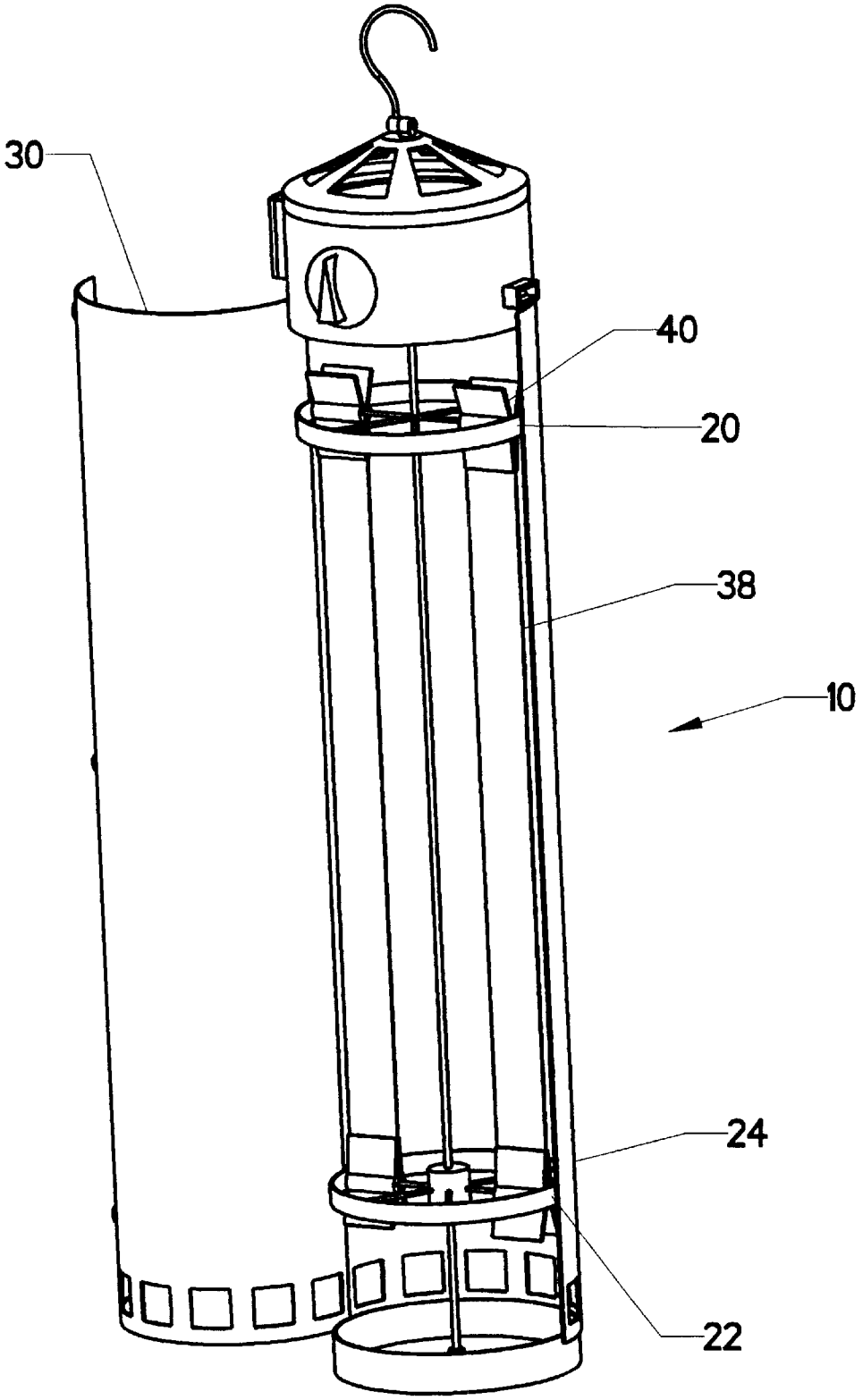
FIG. 2 is an isometric view, showing the hanging of the film.

FIG. 2 shows portable film dryer 10 with access flap 30 in the open position. Film strips 38 have been suspended between upper film hanger 20 and lower film hanger 22 by the use of clips 40. Clips 40 are commonly plastic-coated spring wire devices. Ordinary wood clothes pins may also be used. The result is that film strips 38 are suspended vertically within shroud 24. The radiating rods found within the film hangers are long enough to accommodate film of many different widths—such as 35 mm and 120 mm.

Upper film hanger 20 holds the weight of film strips 38. Lower film hanger 22 stabilizes them—through he use of weight 62—so the blowing air does not move them about. Although only two film strips 38 are shown, those skilled in the art will appreciate that many more film strips 38 can be placed within the device. Both upper film hanger 20 and lower film hanger 22 are free to rotate about support cable 18. This feature allows the user to rotate the hangers until a position is conveniently located with respect to access flap 30.

Figure 3:
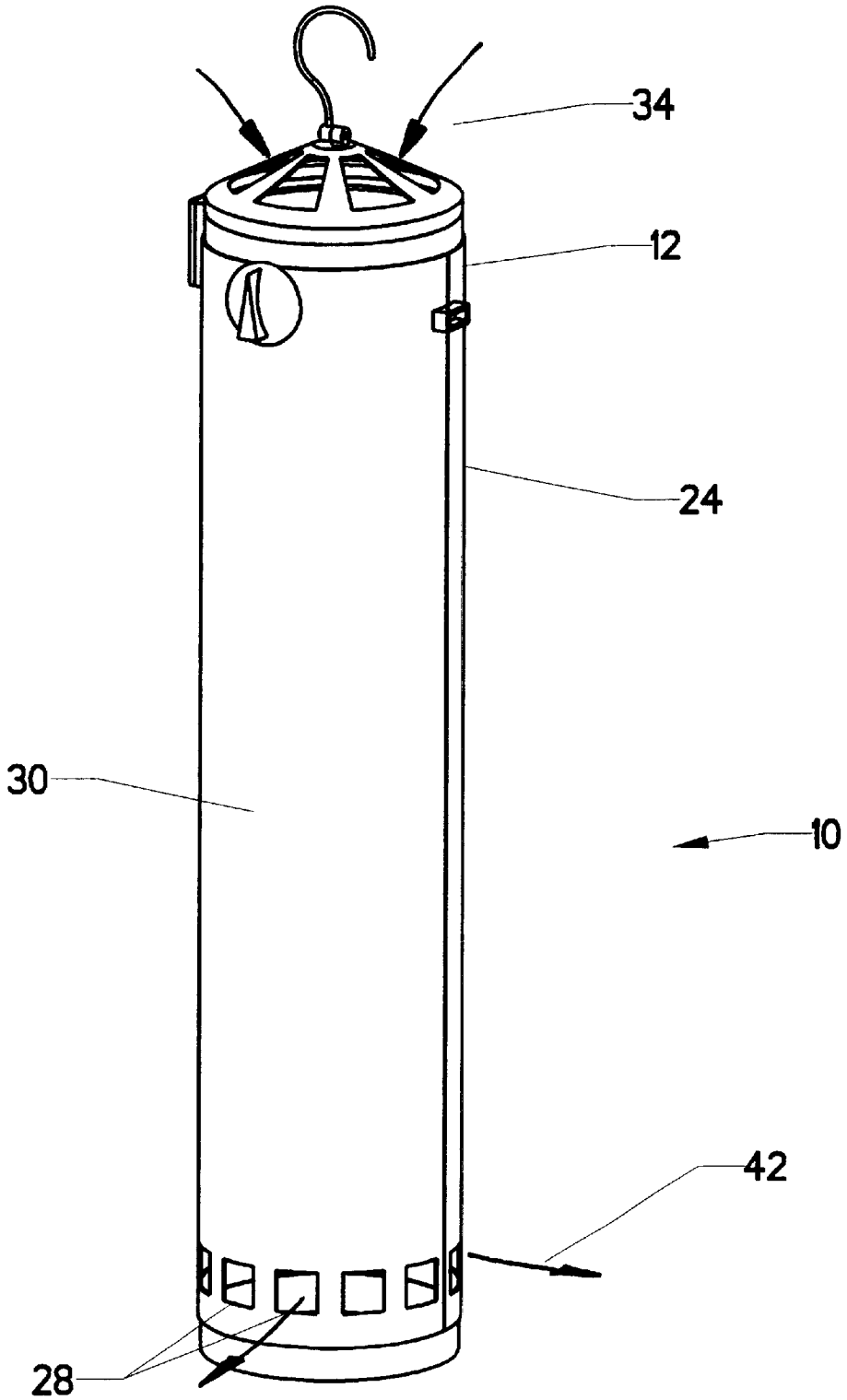
FIG. 3 is an isometric view, showing the invention in operation.

FIG. 3 shows portable film dryer 10 with access flap 30 closed and heater assembly 12 in operation. Ambient air 34 is drawn into heater assembly 12 where it is heated and blown out in a downward direction. Exhaust air 42 eventually exits through exhaust vents 28 in shroud 24. The device typically operates for 10 to 15 minutes in order to completely dry the film contained inside.

Figure 4:
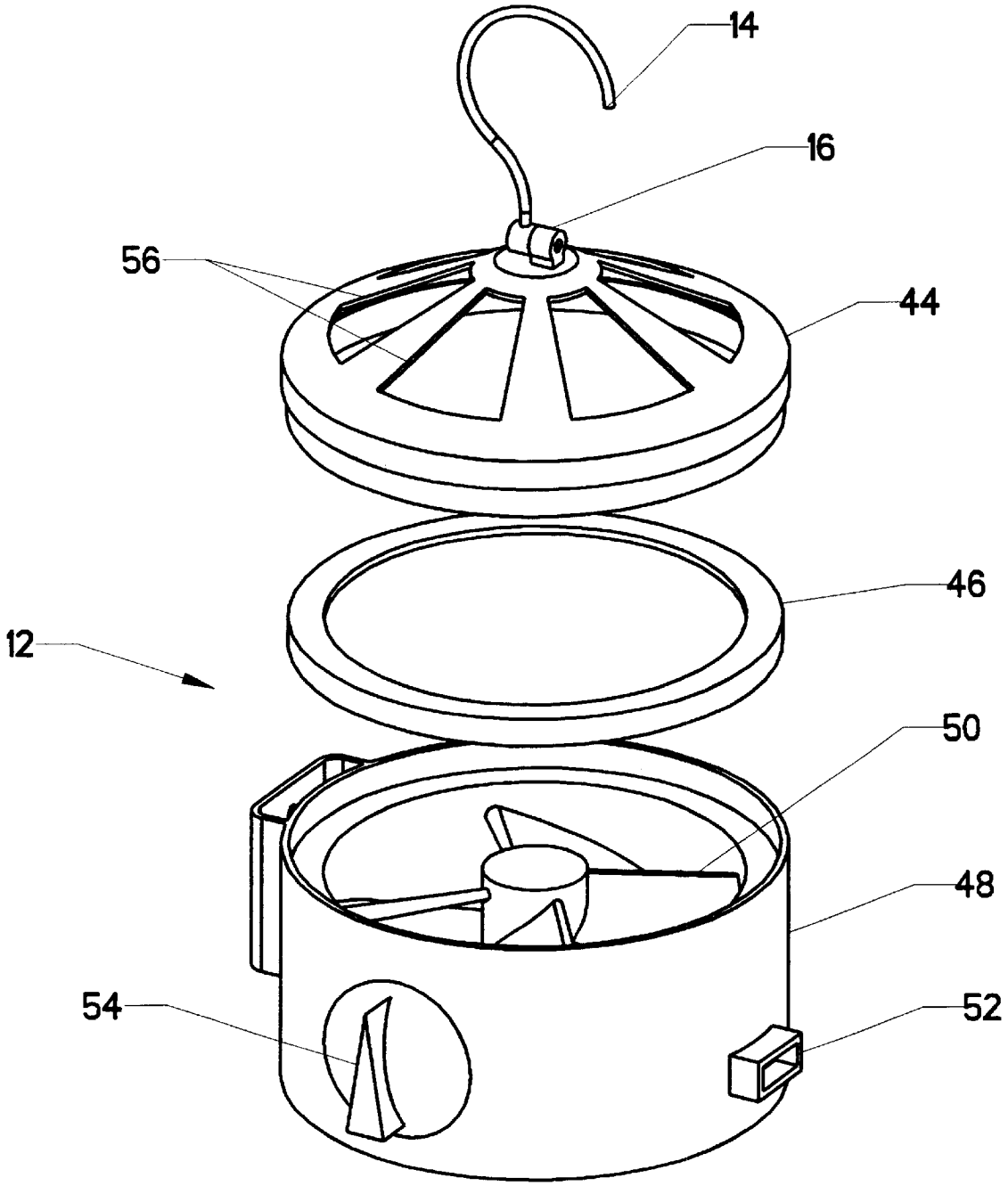
FIG. 4 is an isometric view, showing the internal details of the heater assembly.

FIG. 4 shows some internal details of heater assembly 12. The reader will observe that top 44 detaches from body 48. Top 44 contains several air intakes 56, which allow the entry of ambient air when the device is operating. Sandwiched between top 44 and body 48 is filter cartridge 46. This replaceable unit filters dust from the incoming air before it is heated and blown onto the film. It must be periodically replaced.

Hanging hook 14 is attached to top 44 by swivel 16, which allows hanging hook 14 to fold against top 44 when the invention is stored. Top 14 is removably joined to body 48 by any conventional means, with mating threads being found to be particularly effective.

Body 48 contains fan 50, which moves the air through heater assembly 12 and directs it toward the film. A heating element (not shown) is positioned beneath fan 50. This heating element is typically an electrical-resistance type. Electrical power is provided to fan 50 and the heating element by power input 52. Heater assembly 12 can have either an internal or external AC to DC converter/transformer assembly, so that the invention can run on either AC household power or DC power as provided by automotive cigarette lighters and the like.

Timer 54 is a user-adjustable knob that allows the user to set how long heater assembly 50 will run. The particular unit employed can be varied between 0 and 30 minutes. No temperature adjustment is shown, as one set temperature works well for all applications. However, it would be a simple matter to provide temperature control means in addition to the timer shown It is also important to provide safety circuitry, which would prevent ground faults. Another sensing circuit which disables the heating element if the fan is not running would also be recommended.

Figure 4B:
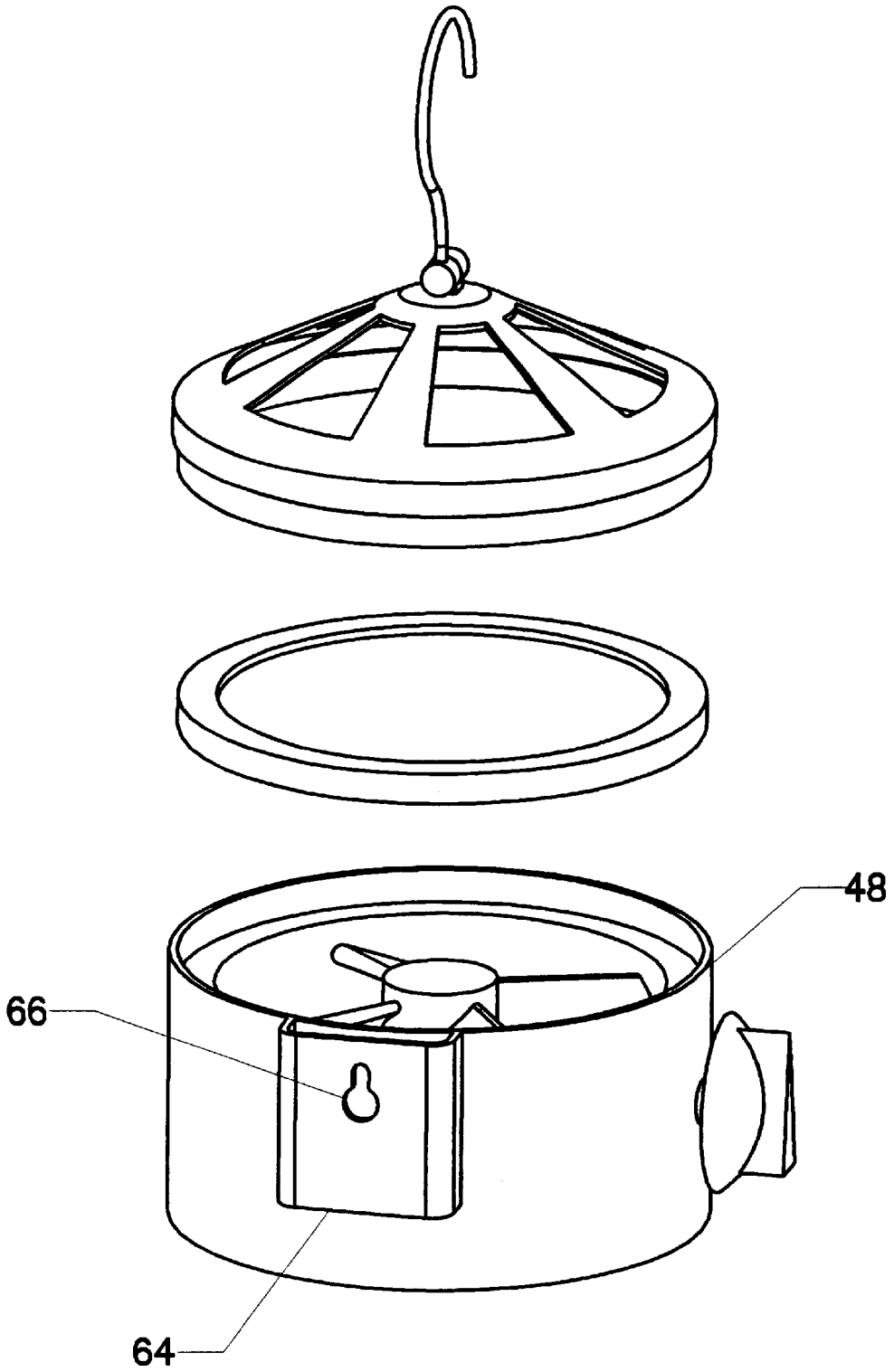
FIG. 4B is an isometric view, showing the heater assembly from another angle.

FIG. 4B shows body 48 from a different angle. On some occasions a shower curtain or clothes rod will not be available. Mounting boss 64 is provided so that the unit may be mounted directly on a wall. Mounting boss 64 has conventional keyhole slot 66. The reader will observe that keyhole slot 66 has a large opening and a small slot intersecting the large opening. This allows the user to place keyhole slot 66 over a nail or screw in the wall, thereby mounting the dryer directly on the wall.

Figure 5:
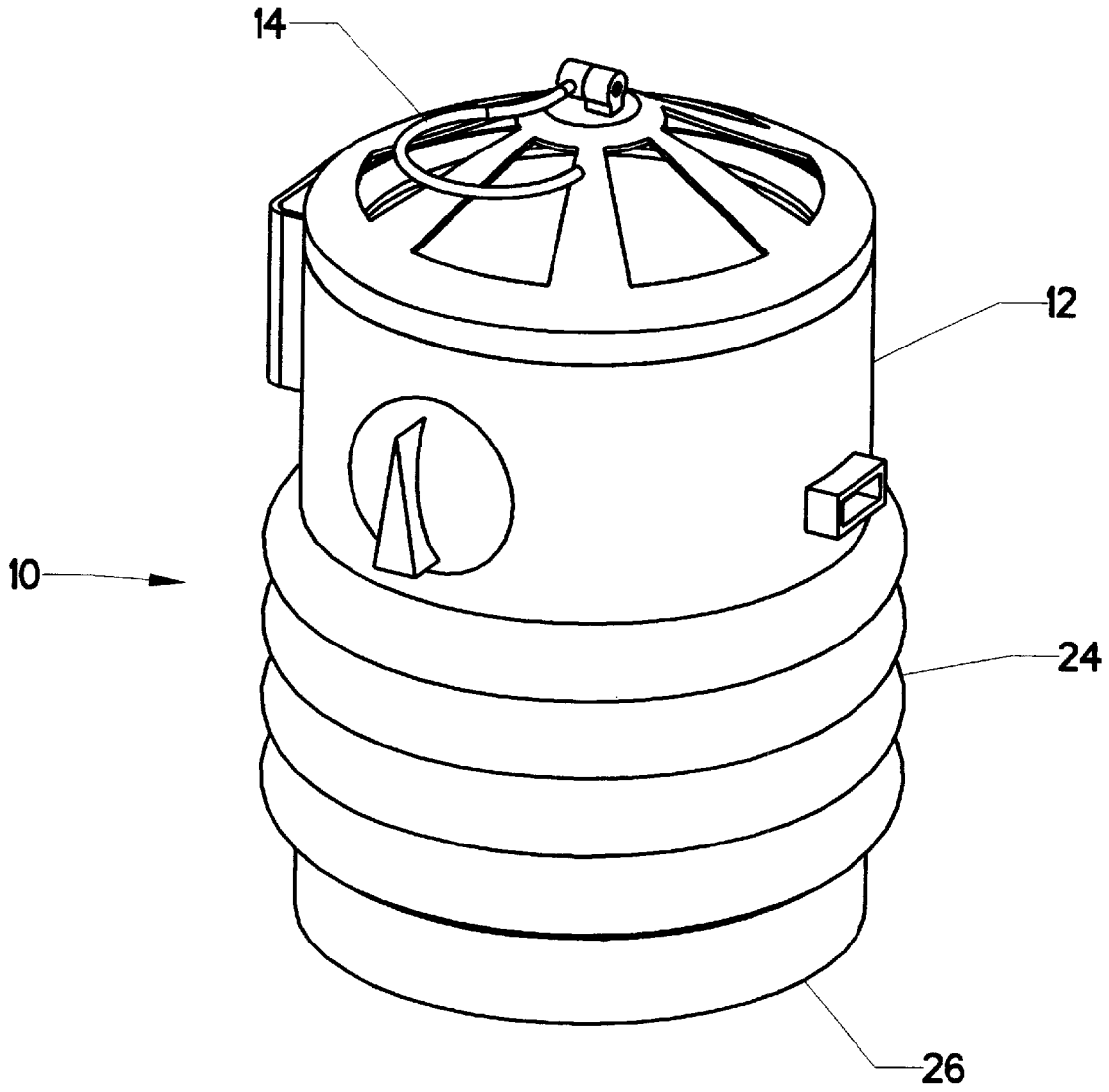
FIG. 5 is an isometric view, showing the invention in its collapsed state.

FIG. 5 shows portable film dryer 10 in a collapsed state suitable for transportation and storage. Shroud 24, which is a thin and flexible material, is collapsed so that heater assembly 12 rests nearly on top of drip pan 26. Hanging hook 14 has been folded down against the upper portion of heater assembly 12. The reader will observe that the resulting unit is very compact and easily stored. A securing strap can be provided to lock the unit in the collapsed state shown. As such a device is well known in the prior art, it has not been illustrated.

Figure 6:
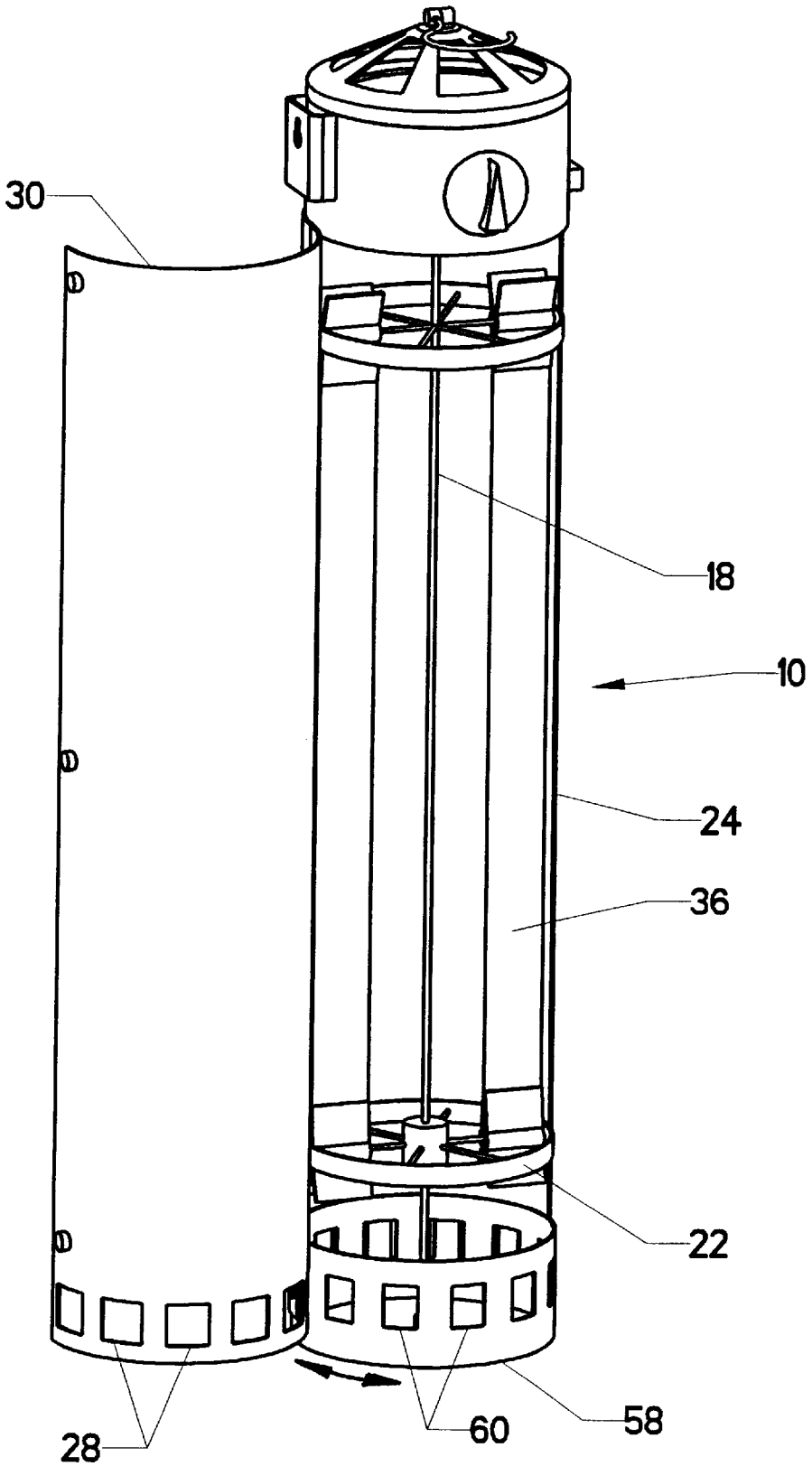
FIG. 6 is an isometric view, showing an alternate embodiment.

FIG. 6 shows an alternate embodiment of the invention. Alternate drip pan 58 is substituted for drip pan 26. Alternate drip pan 58 has a plurality of throttle vents 60, which correspond to exhaust vents 28 in shroud 24. Alternate drip pan 58 can be rotated with respect to shroud 24. This rotation will affect the alignment of throttle vents 60 with exhaust vents 28. By rotating alternate drip pan 58, the user can thereby adjust the exhaust area of exhaust vents 28, thereby regulating the airflow through the device.

Accordingly, the reader will appreciate that the proposed invention provides a portable film dryer which:

1. Is inexpensive;
2. Is compact;
3. Prevents dust contamination; and
4. Prevents the formation of streaks or spots on the film during the drying process.

Although the preceding description contains significant detail, it should not be construed as limiting the scope of the invention but rather as providing illustrations of the preferred embodiment of the invention. As an example, shroud 24 could be made from rigid material which would allow the invention to stand upright on a counter (although reducing the desired goal of compact storage). The cylindrical shape shown could be modified to square or any other desired shape. None of these changes—or other changes of similar scope—would effect the basic nature of the invention disclosed. Thus, the scope of the invention should be fixed by the following claims, rather than by the examples given.

Having described my invention, I claim:

1. A film dryer for allowing a user to dry a plurality of film strips, each of which has a first end and a second end, comprising:

a. a heater assembly, having an upper portion, a lower portion, and an outer perimeter, containing a fan and a heating element positioned to draw ambient air in through said upper portion, heat said air as it passes through said heater assembly, and discharge said air downward out of said lower portion;

b. hanging means, capable of removably affixing said heater assembly to a supporting object;

c. an upper film hanger, suspended beneath said lower portion of said heater assembly, to which said user can attach said first ends of said film strips; and d. an encircling shroud, descending downward from said outer perimeter of said heater assembly and containing within said upper film hanger and said film strips, so that said air discharged downward out of said lower portion of said heater assembly is forced to flow over said film strips, wherein said encircling shroud is divided into a fixed portion and an access flap so that said user can open said access flap and thereby gain access to substantially all the interior of said shroud, thereby facilitating the hanging of said film strips.

2. A film dryer as recited in claim 1, further comprising a lower film hanger, suspended beneath said upper film hanger, to which said user can attach said second ends of said film strips, so as to prevent said film strips from moving under the influence of said discharged air and thereby coming into contact with each other.

3. A film dryer as recited in claim 2, wherein said lower film hanger further comprises a weight so as to maintain tension on said film strips.

4. A device as recited in claim 2, further comprising:

a. wherein said encircling shroud has an upper end attached to said lower portion of said heater assembly, and a lower end which is open;

b. a drip pan, suspended beneath said lower film hanger and sealed to said lower open end of said encircling shroud so as to block said lower open end; and c. wherein said encircling shroud has a plurality of exhaust vents positioned near its said lower end, so that said air discharged downward out of said lower portion of said heater assembly is forced to flow over said film strips and out through said exhaust vents.

5. A device as recited in claim 4, wherein said user can vary the exhaust area of said exhaust vents, thereby regulating the flow of said air discharged downward.

6. A device as recited in claim 4, wherein said heater assembly further comprises control means whereby said user can set a specified time for said film dryer to operate.

7. A device as recited in claim 4, wherein said heater assembly is powered by household electrical current.

8. A device as recited in claim 4, wherein said heater assembly is powered by low voltage direct electrical current.

9. A device as recited in claim 4, wherein said heater assembly further comprises control means whereby said user can control the temperature of said air discharged from said heater assembly.

10. A device as recited in claim 4, wherein said user can vary the exhaust area of said exhaust vents, thereby regulating the flow of said air discharged downward.

11. A device as recited in claim 4, wherein said encircling shroud is made of flexible material so that said heater assembly, said encircling shroud, said upper film hanger, said lower film hanger, and said drip pan can all be collapsed into a compact unit when not in use.

12. A device as recited in claim 1, wherein said heater assembly further comprises control means whereby said user can set a specified time for said film dryer to operate.

13. A device as recited in claim 1, wherein said heater assembly is powered by household electrical current.

14. A device as recited in claim 1, wherein said heater assembly is powered by low voltage direct electrical current.

15. A device as recited in claim 1, wherein said heater assembly further comprises control means whereby said user can control the temperature of said air discharged from said heater assembly.

16. A device as recited in claim 1, wherein said heater assembly further comprises an air filter positioned to trap particulate contamination in said ambient air before it is discharged downward out of said lower portion.

* * * * *